United States Patent [19]

Waldman

[11] Patent Number: 4,527,923

[45] Date of Patent: Jul. 9, 1985

[54] LOOSELEAF BINDER FOR COMPUTER PAPER

[75] Inventor: Morton Waldman, Margate, N.J.

[73] Assignee: Data Bind Inc., Margate, N.J.

[21] Appl. No.: 513,649

[22] Filed: Jul. 15, 1983

[51] Int. Cl.[3] ..... B42F 13/00; B42F 13/16

[52] U.S. Cl. ..... 402/75; 402/77

[58] Field of Search ..... 402/75, 77; 282/12 A

[56] References Cited

U.S. PATENT DOCUMENTS

| | | | |
|---|---|---|---|
| 2,884,262 | 4/1959 | Stratton | 282/12 A |
| 2,888,934 | 6/1959 | Segal | 402/75 |
| 3,658,364 | 4/1972 | Da Mert | 282/12 A |
| 4,114,869 | 9/1978 | Gladow et al. | 282/12 A |

FOREIGN PATENT DOCUMENTS

| | | | |
|---|---|---|---|
| 534728 | 12/1958 | Canada | 282/12 A |
| 1171349 | 1/1959 | France | 282/12 A |

*Primary Examiner*—Paul A. Bell
*Assistant Examiner*—Paul M. Heyrana, Sr.
*Attorney, Agent, or Firm*—Robert K. Youtie

[57] ABSTRACT

A looseleaf ring binder for computer paper having perforate longitudinal margins, the binder rings and paper perforations being arranged for passage of the rings selectively through perforations of opposite margins, or perforations of the same margin.

4 Claims, 3 Drawing Figures

FIG. 1
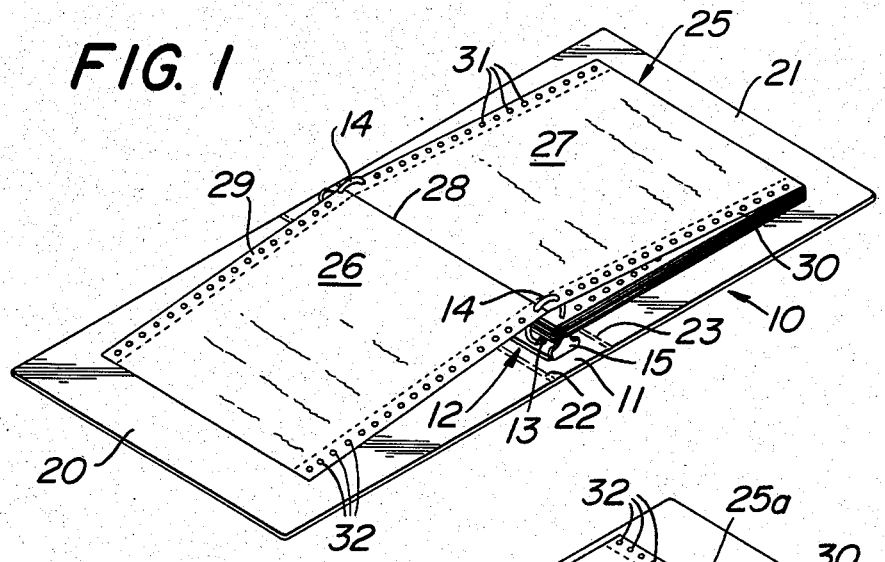
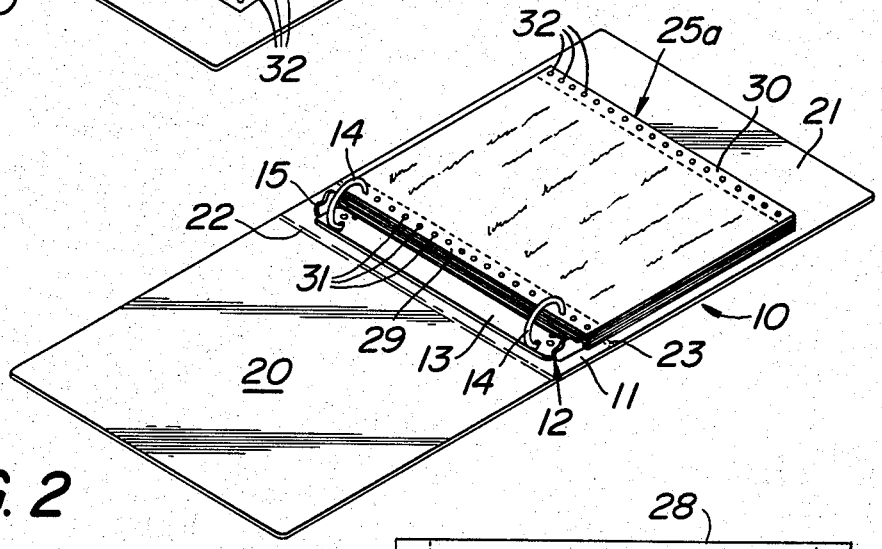
FIG. 2
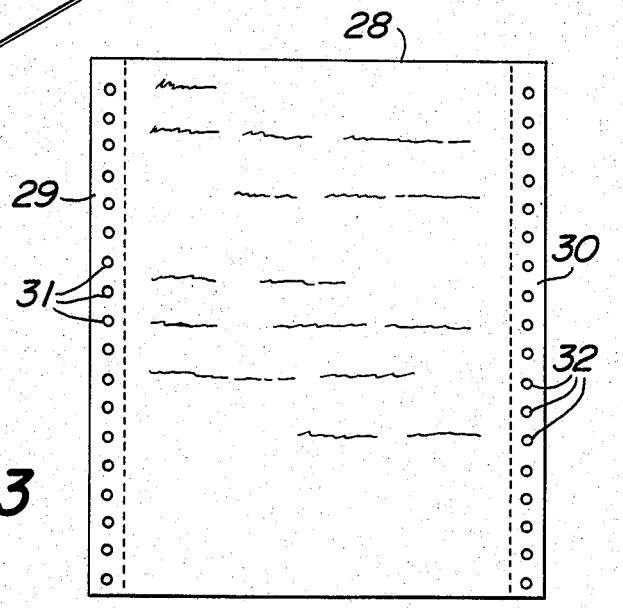
FIG. 3

LOOSELEAF BINDER FOR COMPUTER PAPER

BACKGROUND OF THE INVENTION

As is well known, with the proliferation of computers, there is an extremely rapidly growing accumulation of computer printout. Computer printout is conventionally on continuous, accordion or fanfold paper having marginal perforations. Commonly it is the practice to accumulate the computer paper in fanfold form for storage in the original paper cartons. Another storage procedure is that of sheeting the printout by separating along the folds into sheets for binding by prong paper fasteners, or the like. In both procedures storage becomes an expensive and time consuming operation, and access at a later date to desired information is very difficult.

SUMMARY OF THE INVENTION

Accordingly, it is an important object of the present invention to provide a unique combination of looseleaf binder and filler or contents wherein the contents may be continuous marginally perforated computer paper, either fanfolded or sheeted, with the binder rings selectively passing through either laterally spaced perforations of opposite margins, or longitudinally spaced perforations of the same margin.

It is a further object of the present invention to provide a novel looseleaf binder of the type described adapted for binding relation with computer printout paper in the manner of the previous paragraph, without special preparation of the paper, and in which the paper remains in its original form with the information thereon quickly and easily accessible.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 1 is a top perspective view showing a binder and filler of the present invention in an open condition, with the binder rings passing through laterally spaced opposite marginal perforations of the computer paper.

FIG. 2 is a top perspective view showing the binder and filler of the present invention with the computer paper receiving the binder rings through longitudinally spaced perforations along one margin of the computer paper.

FIG. 3 is a plan view showing a single sheet of computer paper.

DESCRIPTION OF THE PREFERRED EMBODIMENTS

Referring now more particularly to the drawings, and specifically to FIG. 1 thereof, a looseleaf or ring binder is generally designated 10, and may include a central elongate part or spine 11 carrying a ring assembly 12. The ring assembly 12 includes a base 13 extending longitudinally along the inner side of and riveted or otherwise securely fastened to the spine or back member 11. Spaced longitudinally of the base 13 are a pair of openable or split rings 14. The rings 14 are in substantial alignment with each other longitudinally of the spine 11, and may be simultaneously openable, as by an actuating member or tab 15 extending from one end of the base 13.

A pair of generally flat cover panels 20 and 21 may be swingably connected in edge to edge relation wiih respective longitudinal side edges of spine 11, as by flexible sheet material or other hinge means 22 and 23. The panels 20 and 21 may be considered as front and back covers, and are generally of rectangular configuration.

Illustrated in FIG. 1 as bound in the binder 10 is a continuous length of computer paper, generally designated 25. The computer paper is in its normal accordion or fanfolded condition, being constituted of a plurality of generally rectangular sheets, such as the adjacent sheets 26 and 27 extending in end to end relation and hingedly connected together by a fold, crease or line of weakening 28. That is, the computer paper 25 is constituted of an elongate web having its longitudinal margins 29 and 30 perforated to define respective rows of through holes or perforations 31 and 32. Thus, the elongate paper web of computer paper is formed with a plurality of equally spaced, oppositely bent folds or creases defining therebetween generally rectangular sheets, each adjacent pair of which is connected together by an intermediate fold or line of weakening.

In practice, the sheets, as at 26 and 27, into which the computer paper 25 is folded, are of a conventional rectangular size, such as 9½ inches by 11 inches, or other. With the rectangular sheets of computer paper stacked one upon the other, as in the closed fanfold condition, the perforations 31 of each sheet will overlie and register with the perforations 31 of all other sheets. Similarly, the perforations 32 of each sheet will be aligned with the perforations 32 of all other sheets.

In the bound condition of FIG. 1, it is seen that each ring 14 will extend entirely through a series of aligned perforations 31 and 32. Further, each ring 14 will extend through a laterally spaced and laterally aligned pair of perforations 31 and 32 of each paper sheet. In practice, the rings 14 may extend through the endmost perforations of each sheet, as illustrated, or the penultimate perforation of each sheet, depending upon the ring diameter.

It will now be apparent that the spacing between aligned, openable rings 14 is equal to the lateral spacing between the row of perforations 31 and 32. Also, the dimension of covers 20 and 21 extending generally normal to the spine 11 is advantageously sufficient to extend beyond and protect the longer dimension of length of the sheets.

It will therefore be apparent that the fanfolded computer paper 25, as bound in the binder 10, has its sheets (as at 26 and 27) swingable about the axis of rings 14 to open and simultaneously present to view each adjacent pair of sheets. As the computer paper is printed on one side only, all the contents thereof are readily accessible with the paper remaining in its fandfolded condition.

Alternatively, as seen in FIG. 2, the binder 10 may serve to bind the computer paper **25*a* in either a fanfolded or sheeted condition, with the several sheets separated from each other. The computer paper 25*a* is arranged with one margin 29 adjacent to the spine 11 and the other margin 30 remote from the spine. Further, the spacing between successive holes 31 and 32 is such that said spacing is evenly divisible into the lateral spacing betwen the holes 31 of margin 29 and the holes 32 of margin 30. Therefore, the pair of rings 14 may be inserted through a pair of spaced holes 31 along margin 29 equal to the spacing between a pair of laterally aligned holes 31 and 32. This condition is shown in FIG. 2. Of course, the rings 14 may be similarly inserted through a pair of like spaced holes 32**.

The dimension of the covers 20 and 21 longitudinally of the spine 11 is advantageously sufficient to cover and protect the length of the computer paper sheets, so that the outline configuration of the covers 20 and 21 may be generally square.

In the bound condition of FIG. 2, the computer paper 25*a* may remain fanfolded, and may be removed from the rings 14 for use; or, the computer paper may be separated into sheets and form bound, looseleaves in a binder.

Of course, the binder 10 may be simply labeled, as on the exterior of the spine 11 for ready reference to the contents.

From the foregoing it is seen that the present invention provides a ring binder for computer paper which is extremely simple to use both in the binding procedure and in accessing the contents of the binder, and otherwise fully accomplishes its intended objects.

Although the present invention has been described in some detail by way of illustration and example for purposes of clarity of understanding, it is understood that certain changes and modifications may be made within the spirit of the invention.

What is claimed is:

1. In combination, a looseleaf ring binder including at least a pair of spaced aligned openable rings; and a length of continuous computer paper including perforated longitudinal margins, the distance between laterally opposed pairs of perforations of said margins being equal to the distance between said spaced openable rings and said distance being an even multiple of the distance between successive longitudinally spaced perforations along each margin, whereby said computer paper may selectively be fanfolded for binding with said rings passing through the laterally spaced pair of perforations, and optionally sheeted for binding with the rings passing through longitudinally or laterally spaced pairs of perforations.

2. The combination according to claim 1, said binder including only two rings.

3. The combination according to claim 1, said perforate longitudinal margins having multiple overlying margin portions with the perforations thereof in respective alignment when said paper is fanfolded, for passage of said rings through aligned perforations.

4. The combination according to claim 1, said binder comprising a spine mounting said rings, and front and back covers hinged to and extending from opposite sides of said spine, said covers being of a generally square outline configuration having a side dimension corresponding to the larger dimension of said paper when fanfolded or sheeted to protectively receive the paper with the rings passing through the laterally spaced pair of perforations or the longitudinally spaced pair of perforations.

* * * * *